United States Patent [19]

Loughridge

[11] 4,311,400

[45] Jan. 19, 1982

[54] SHIFT SENSITIVE DUAL VELOCITY MECHANISM FOR A PRINTER

[75] Inventor: Mark Loughridge, Lexington, Ky.

[73] Assignee: International Business Machines Corporation, Armonk, N.Y.

[21] Appl. No.: 173,797

[22] Filed: Jul. 30, 1980

[51] Int. Cl.[3] ..... B41J 1/32

[52] U.S. Cl. ..... 400/166; 400/161.4; 400/253; 400/257

[58] Field of Search ..... 400/161.4, 166, 253, 400/257

[56] References Cited

U.S. PATENT DOCUMENTS

| | | | |
|---|---|---|---|
| 3,239,049 | 3/1966 | Voit, Jr. | 400/166 |
| 3,983,984 | 10/1976 | de Kler | 400/161.4 |
| 4,094,397 | 6/1978 | Hughes | 400/161.4 |

OTHER PUBLICATIONS

IBM Technical Disclosure Bulletin, "Shift Sensitive with Interlocked Bail", Bushmiaer et al., vol. 19, No. 7, Dec. 1976, pp. 2614–2615.

*Primary Examiner*—Ernest T. Wright, Jr.
*Attorney, Agent, or Firm*—Frank C. Leach, Jr.; Laurence R. Letson

[57] ABSTRACT

A single print element of a typewriter has the characters thereon impact a record sheet at one of two velocities depending on the area of coverage of the character. Each character on the print element is selected for printing by movement of one of a plurality of interposers with each interposer selecting two characters. One of the two characters is selected by movement of the interposer when a pair of operatively connected shift levers is not depressed while the other of the characters is selected by the same interposer when the shift levers are depressed. A vane, which extends between the shift levers and is pivotally connected thereto, is disposed in the path of movement of all of the interposers. The vane has an opening for each interposer when the print element is to impact the record sheet at the higher velocity so that the vane is not engaged by the interposer during movement of the interposer. If the print element is to strike the record sheet at the lower velocity, then the vane has a portion for engagement by the moving interposer. The vane has a first group of openings and portions for cooperation with the interposers when the shift levers are not depressed and a second group of openings and portions for cooperation with the interposers when the shift levers are depressed. When the vane is engaged, the print element strikes the record sheet at the lower velocity.

13 Claims, 7 Drawing Figures

SHIFT SENSITIVE DUAL VELOCITY MECHANISM FOR A PRINTER

This invention relates to a mechanism for controlling the velocity at which a single print element of a printer such as a typewriter, for example, strikes a record sheet and, more particularly, to a shift sensitive dual velocity mechanism for controlling the velocity at which a single print element of a printer such as a typewriter, for example, impacts a record sheet.

In a typewriter having a single print element for printing characters on a sheet of paper through a ribbon, a key factor in the quality of the print is the velocity at which the single print element impacts the paper. With characters having areas of relatively high coverage, it is desired that the single print element strike the paper through the ribbon with a high velocity in comparison with the velocity employed for printing characters having an area of relatively low coverage.

If the same velocity is utilized for all of the characters, the characters with areas of high coverage will be faint if the velocity is selected so that characters having areas of relatively low coverage such as a period, for example, do not strike the paper with sufficient velocity to pierce the paper. If the velocity is selected so that the characters having areas of relatively high coverage are not faint, this velocity would cause the characters having areas of relatively low coverage such as a period, for example, to pierce the paper.

Thus, it is desired to be able to have at least two different velocities at which a single print element impacts the paper through the ribbon. One previous mechanism for controlling the velocity at which the single print element impacts the paper through the ribbon has utilized a mechanism sensitive to the shift control means. In this previous arrangement, some of the characters in the lower case and some of the characters in the upper case have been applied to the paper at a low velocity while the remainder of the characters in each case have been applied with a high velocity.

This prior control mechanism has utilized a vane having lower case character lugs to engage certain interposers to pivot the vane when one of the interposers moves to select the lower case character. This pivoting of the vane by movement of an interposer, which is moved when a specific lower case character is selected, results in the single print element striking the paper at the low velocity.

When the shift mechanism is activated through depressing a shift key on the keyboard so that a pair of operatively connected shift levers pivots, the vane slides transversely to the paths of movement of the interposers in response to movement of a shift sensing cable, which has its tension relaxed when the shift mechanism is shifted to upper case. This sliding movement of the vane positions all of the lower case character lugs, which were effective during lower case character selection, to positions between the paths of movement of the interposers so that the lower case character lugs cannot engage any of the interposers when the interposers are moved.

The vane has upper case character lugs thereon disposed in the path of movement of interposers which select upper case characters that are to impact the paper at the low velocity. When the upper case character selected by the moving interposer is to impact the paper at the low velocity, one of the upper case character lugs is engaged by the moving interposer to cause pivoting of the vane in the same manner as when one of the lower case character lugs is engaged by one of the moving interposers. Thus, the lower case character lugs and the upper case character lugs are positioned alternately along the vane where such are required since the upper case character lugs are out of the path of movement of any of the interposers when the shift mechanism is not effective and the lower case character lugs are out of the path of movement of any of the interposers when the shift mechanism is effective.

Thus, this prior control mechanism has required a sliding action of the vane when the shift mechanism is activated. It also has required a relatively expensive structure for sensing movement of the shifting mechanism and for supporting sliding movement of the vane in response thereto.

The dual velocity mechanism of the present invention satisfactorily overcomes the foregoing problem through providing a shift sensitive mechanism that eliminates the requirement for any support hardware for a sliding vane. This results in a reduction of about ninety percent in the number of parts required and the cost in comparison with the prior dual velocity mechanism having the sliding vane.

The mechanism of the present invention utilizes a readily replaceable coding means for the characters. Thus, the coding means can be easily changed when desired.

The mechanism of the present invention utilizes a pivotally mounted vane having first means cooperating with each of the interposers when the shift means is not effective and second means cooperating with each of the interposers when the shift means is effective. The mechanism of the present invention eliminates the shifting vane of the prior mechanism through pivotally mounting the vane on a pair of operatively connected shift levers of the shift means so that movement of the shift levers carries the vane therewith whereby the second means cooperates with the interposers rather than the first means.

The mechanism of the present invention also eliminates the structure for sensing the movement of the shift means. This is because the vane of the present invention is mounted on the shift levers for movement therewith and does not require any structure to sense this movement of the shift means and transmit this movement to a structure to cause movement of the vane.

When the single print element is to impact the paper through the ribbon at the lower velocity, the first means or the second means is preferably a portion of the vane engaged by the interposer so that the vane pivots about its pivotal connection to the shift levers. This pivoting of the vane causes a linkage to activate a velocity control means so that the single print element impacts the paper through the ribbon at the lower velocity.

When the single print element is to impact the paper through the ribbon at the higher velocity, the first means or the second means is preferably an opening in the vane to enable the interposer to pass therethrough without engaging the vane. Thus, the vane does not pivot so that the velocity control means causes the single print element to impact the paper through the ribbon at the higher velocity.

An object of this invention is to provide a mechanism for controlling the impact velocity of a single print element of a printer in accordance with the area of coverage of the character to be printed.

Another object of this invention is to provide a mechanism for causing the impact of characters of a single print element having areas of relatively low coverage with a lower velocity than characters having areas of relatively large coverage.

A further object of this invention is to provide a mechanism for controlling the impact velocity of a single print element of a printer with a relatively simple mechanism.

The foregoing and other objects, features, and advantages of the invention will be apparent from the following more particular description of the preferred embodiment of the invention as illustrated in the accompanying drawing.

Figure 1:
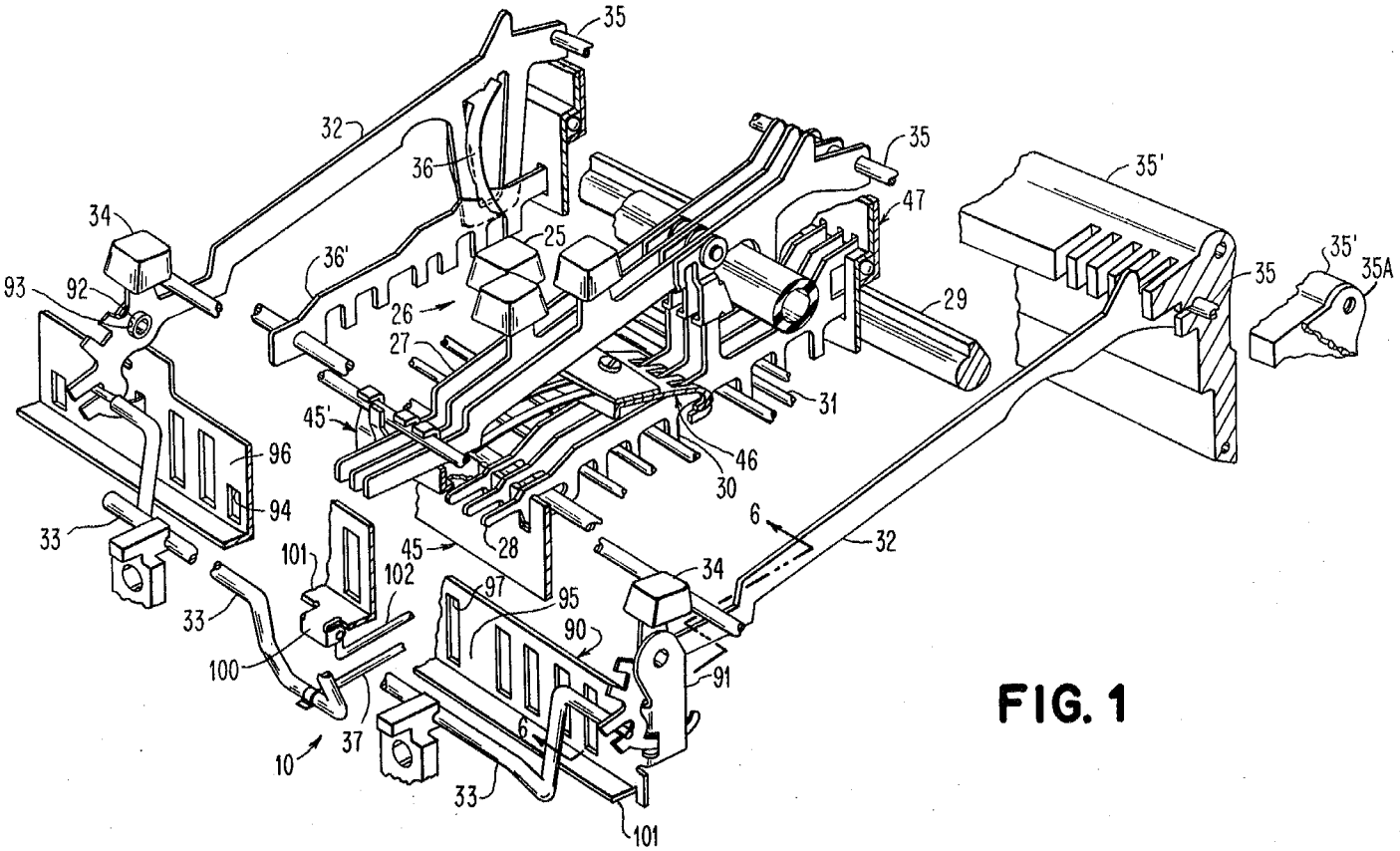
FIG. 1 is a perspective view of a portion of a single print element typewriter with parts omitted for clarity purposes and having a shift sensitive dual velocity mechanism of the present invention.
Figure 2:
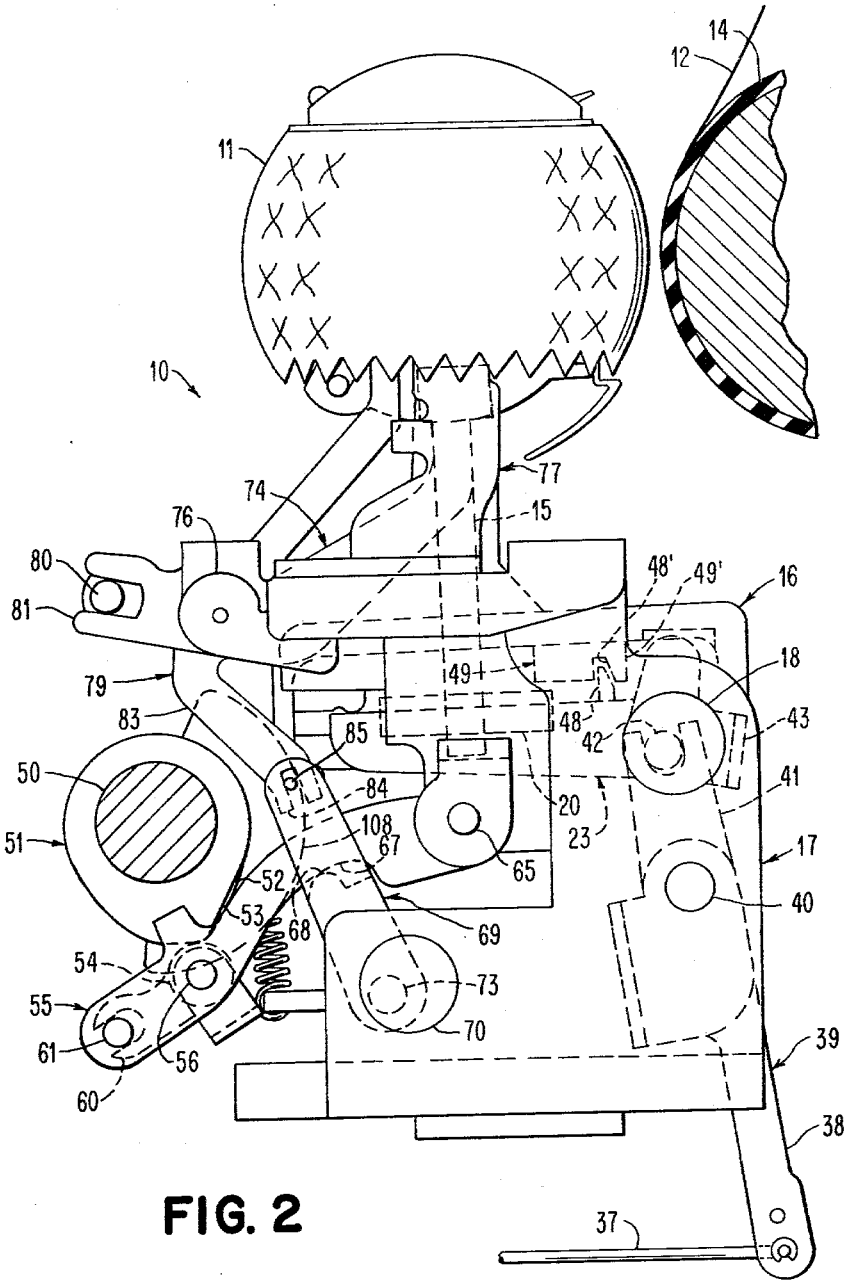
FIG. 2 is a side elevational view of the print element of the typewriter of FIG. 1 and a portion of its support structure.

Referring to the drawing and particularly FIGS. 1 and 2, there is shown a typewriter 10 having a single print element 11 with characters arranged thereon in columns and rows. The single print element 11 is mounted for tilting and rotation to select a character thereon and is adapted to be moved to impact a record sheet 12 such as a sheet of paper, for example, on a platen 14.

The single print element 11 is mounted for tilting movement in any suitable manner such as that shown in U.S. Pat. No. 3,983,984 to de Kler, for example. The aforesaid de Kler, patent is incorporated by reference herein.

The single print element 11 is mounted on a shaft 15, which has a ball joint in its upper portion as shown in the aforesaid de Kler patent, to enable tilting of the single print element 11. The tilting of the single print element 11 selects one of the rows of characters on the single print element 11 for disposition at the printing position.

Figure 4:
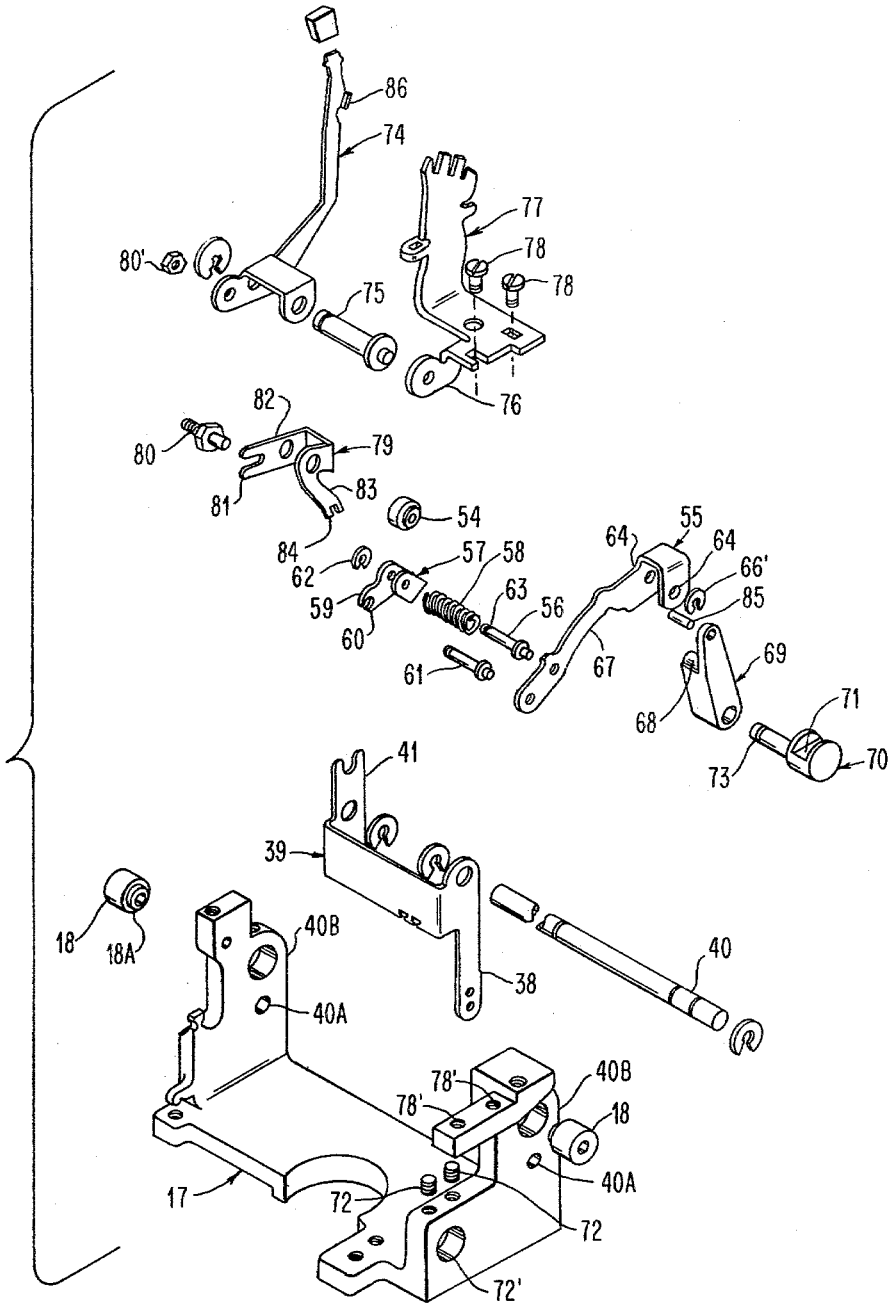
FIG. 4 is an exploded perspective view of a cam follower mechanism and an arm utilized therewith for causing the single print element of the typewriter to impact a record sheet at a selected velocity, a rocker bracket, and a portion of a shifting mechanism.
Figure 5:
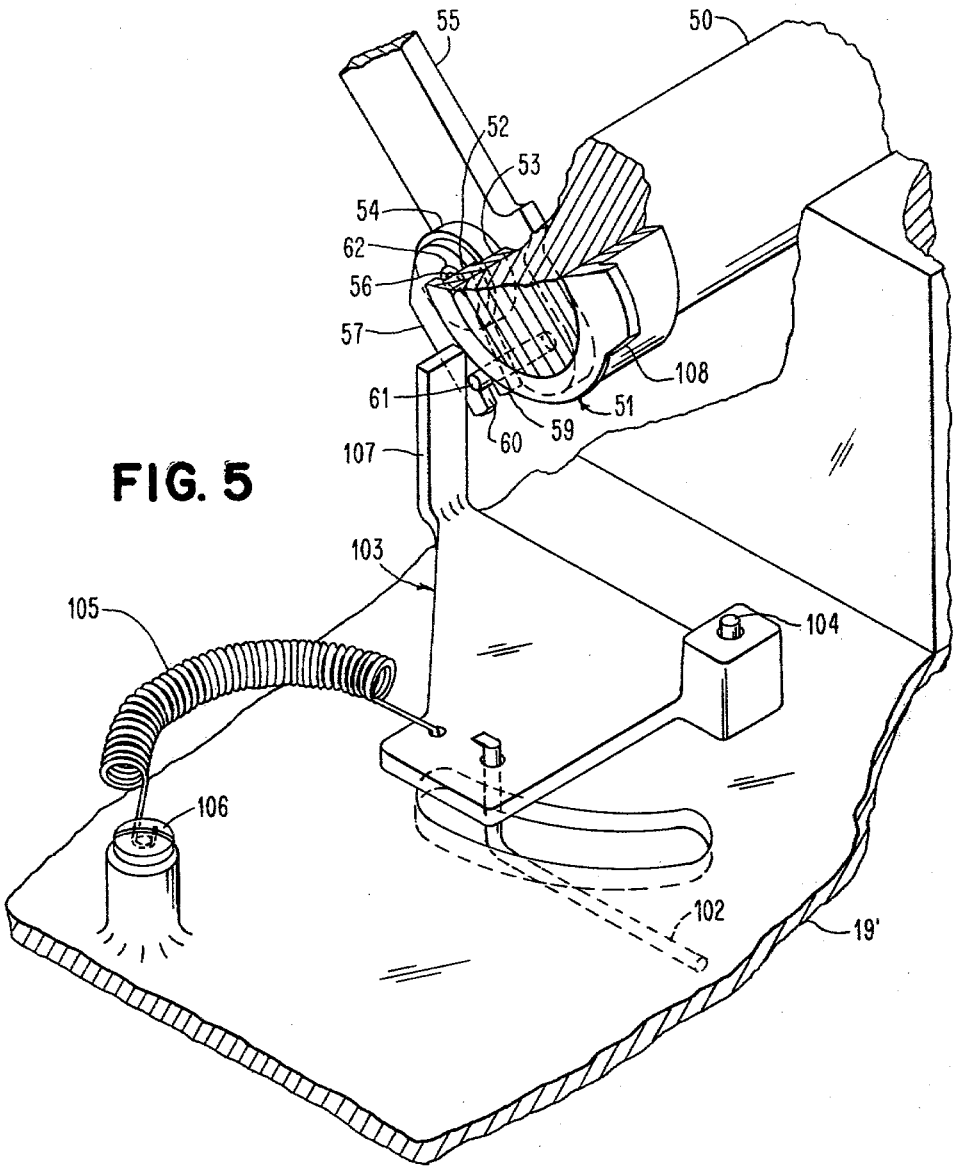
FIG. 5 is a perspective view of a velocity cam, a cam follower, and structure for shifting the cam follower from one of the profiles on the cam to the other.
Figure 6:
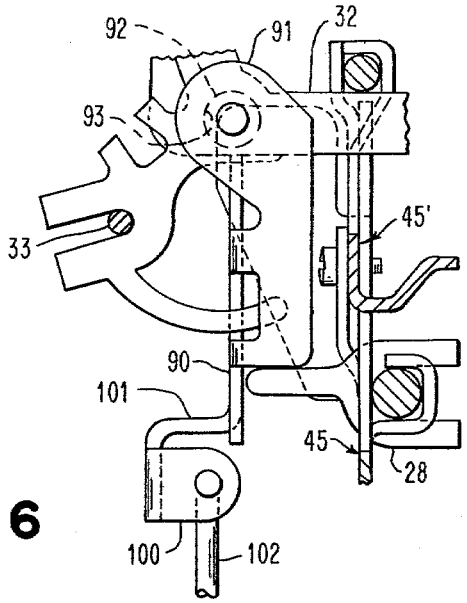
FIG. 6 is a fragmentary side elevational view, partly in section, of a portion of the structure of FIG. 1 and taken along line 6—6 of FIG. 1.
Figure 7:
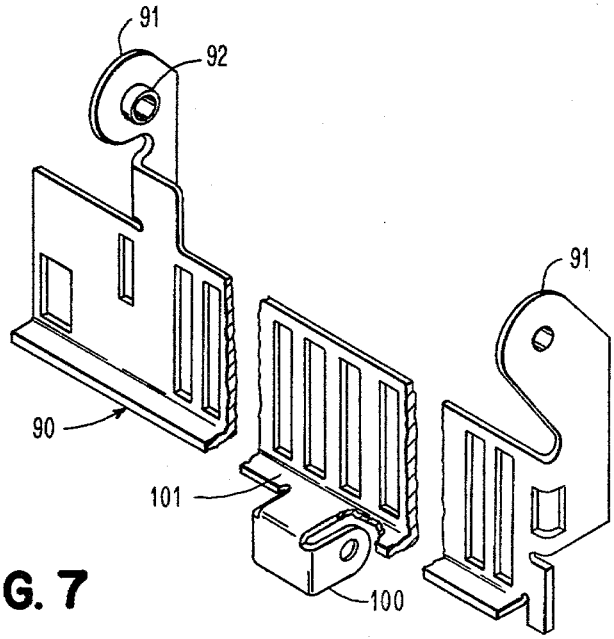
FIG. 7 is a perspective view of portions of the member for determining the velocity at which the selected character is printed.

The shaft 15 is rotatably supported in a rocker 16, which is pivotally mounted in a rocker bracket 17 by bearings 18 in the rocker bracket 17 having reduced portions 18A (see FIG. 4) riding in bearings 19 (see FIG. 3) in opposite sides of the rocker 16. The rocker bracket 17 (see FIG. 2) is supported by a bottom casting 19' (see FIG. 5) of the frame of the typewriter 10. The shaft 15 (see FIG. 2) is rotated to select one of the columns of characters on the single print element 11 for disposition at the printing position.

The lower end of the shaft 15 has a pinion 20 (see FIG. 3) mounted thereon for cooperation with one of a pair of racks 21 and 22 of a rack member 23. The racks 21 and 22 are disposed on opposite sides of the pinion 20. When the pinion 20 is engaged with the rack 21, the print element 11 (see FIG. 2) is rotated in one direction when the rack member 23 is moved in a single direction while engagement of the pinion 20 (see FIG. 3) with the rack 22 causes rotation of the pinion 20 in the opposite direction when the rack member 23 is moved in the same single direction to rotate the print element 11 (see FIG. 2) in the opposite direction.

The amount of movement the rack member 23 to rotate the pinion 20 (see FIG. 3) is determined by the character selected for printing. The amount of movement of the rack member 23 in the single direction to rotate the pinion 20 is controlled in the manner shown in the aforesaid de Kler patent as modified by the structure in U.S. Pat. No. 4,094,397 to Hughes, which is incorporated by reference herein.

The character selected for printing is determined by which one of a plurality of keybuttons 25 (see FIG. 1) of a keyboard 26 is depressed by a typist. Each of the keybuttons 25 is mounted on a pivotally mounted keylever 27 as more particularly shown and described in the copending patent application of C. C. Mayborg et al for "Keylever Pawl Tube Spring and Keyboard Utilizing A Keylever Pawl Tube Spring," Ser. No. 136,001, filed Mar. 31, 1980, and assigned to the same assignee as the assignee of this application. The aforesaid Mayborg et al application is incorporated by reference herein.

As more particularly shown and described in the aforesaid Mayborg et al application, the depression of one of the keybuttons 25 by the typist causes an interposer 28 to be moved by the keylever 27 to a position in which it is driven in a first direction by a filter shaft 29. The interposer 28 has a plurality of code lugs 30 thereon with each of the code lugs 30 cooperating with a selection bail 31. Each of the selection bails 31 causes movement, when the selection bail 31 is moved, of a different one of the links in the aforesaid de Kler patent to remove an interposer block mounted on an interposer connected to the link from the path of movement of one of a pair of shuttle follower blocks as more particularly shown and described in the aforesaid de Kler and Hughes patents.

As more particularly shown and described in the aforesaid de Kler and Hughes patents, one of the pair of shuttle follower blocks causes rotation of the print element 11 (see FIG. 2) and the movement of the other of the pair of shuttle follower blocks produces tilting of the print element 11. Thus, when the character selected is the character at the home position (There is only one character so located.), then there is no movement of either of the shuttle follower blocks when the keybutton 25 (see FIG. 1) is depressed. Any other selected character requires rotation and/or tilt of the print element 11 (see FIG. 2).

Thus, if the selected character is not in the column at the print position when the print element 11 is in its home position, depression of one of the keybuttons 25 (see FIG. 1) produces a selected movement of the rack member 23 (see FIG. 3) in the single direction by one of the pair of shuttle follower blocks in the manner more particularly shown and described in the aforesaid de Kler and Hughes patents. The selected movement of the rack member 23 in the single direction results in a predetermined amount of rotation of the print element 11 (see FIG. 2) by the engaging rack 21 (see FIG. 3) or 22.

If the selected character is not in the row at the print position when the print element 11 (see FIG. 2) is in its home position, then tilting of the single print element 11 occurs when one of the keybuttons 25 (see FIG. 1) is depressed. The amount of tilt and the direction of tilt depends on the row on the print element 11 (see FIG. 2) in which the selected character is located.

Additionally, when one of a pair of pivotally mounted shift levers 32 (see FIG. 1), which are operatively connected to each other by a bail 33, is depressed by a keybutton 34 mounted on the shift lever 32, the shift levers 32 pivot together about a fulcrum rod 35, which is supported by an extrusion 35' mounted between side plates 35A (one shown) of the frame of the typewriter 10, and against the force of a return spring 36, which acts between one of the shift levers 32 and a bail stop 36'. The bail stop 36' limits the movement of the bails 31 by the movement of one of the interposers 28 in the first direction. This pivotal movement of the shift levers 32 causes a shift linkage 37, which has one end connected to the bail 33 and its other end connected to an arm 38 (see FIGS. 2 and 4) of a resiliently biased bellcrank 39 (The bellcrank 39 is biased counterclockwise in FIG. 2.), to pivot about a shaft 40, which is supported in openings 40A in side walls 40B of the rocker bracket 17.

The bellcrank 39 has a second arm 41 on its opposite end from the arm 38. The second arm 41 has a bifurcated open end to receive a shaft 42 (see FIG. 3), which is mounted in a support 43 by extending through a pair of aligned openings 43A in the support 43. The shaft 42 has the rack member 23 slidably mounted thereon through the shaft 42 extending through a pair of aligned openings 43B in the rack member 23. The bracket 43 is pivotally mounted on the rocker 16 by a pair of screws 44 extending through threaded holes 44A (one shown in FIG. 3) in the opposite sides of the rocker 16 and into openings 44B in the support 43.

Thus, when the shift levers 32 (see FIG. 1) are pivoted about the fulcrum rod 35, the pivoting of the bellcrank 39 (see FIGS. 2 and 4) through the shift linkage 37 results in the support 43 (see FIG. 3) pivoting about the screws 44. This moves the rack member 23 so that the rack 22 ceases to engage the pinion 20 while the rack 21 engages the pinion 20.

Therefore, when the shift levers 32 (see FIG. 1) are effective, the single print element 11 (see FIG. 2) is rotated in the opposite direction from when the shift levers 32 (see FIG. 1) are not effective. When the shift levers 32 are effective, one of the upper case characters on the print element 11 (see FIG. 2) is selected. One of the lower case characters on the print element 11 is selected when the shift levers 32 (see FIG. 1) are not effective.

Accordingly, when one of the keybuttons 25 is depressed, one of two characters on the single print element 11 will be selected. If the shift levers 32 are depressed, the upper case character of the two characters will be selected. If the shift levers 32 are not depressed, then the lower case character of the two characters will be selected.

It should be understood that each of the interposers 28 passes through a lower front guide 45, which is supported by the side plates 35A and has an upper front guide 45' adjustably mounted thereon to guide the key-levers 27, and a latch plate 46, which is supported by the side plates 35A, and that the rear of each of the interposers 28 extends into a ball tube guide 47, which is supported by the side plates 35A, in the manner more particularly shown and described in the aforesaid Mayborg et al application. This insures that each of the interposers 28 moves in the first direction when driven by the filter shaft 29.

Figure 3:
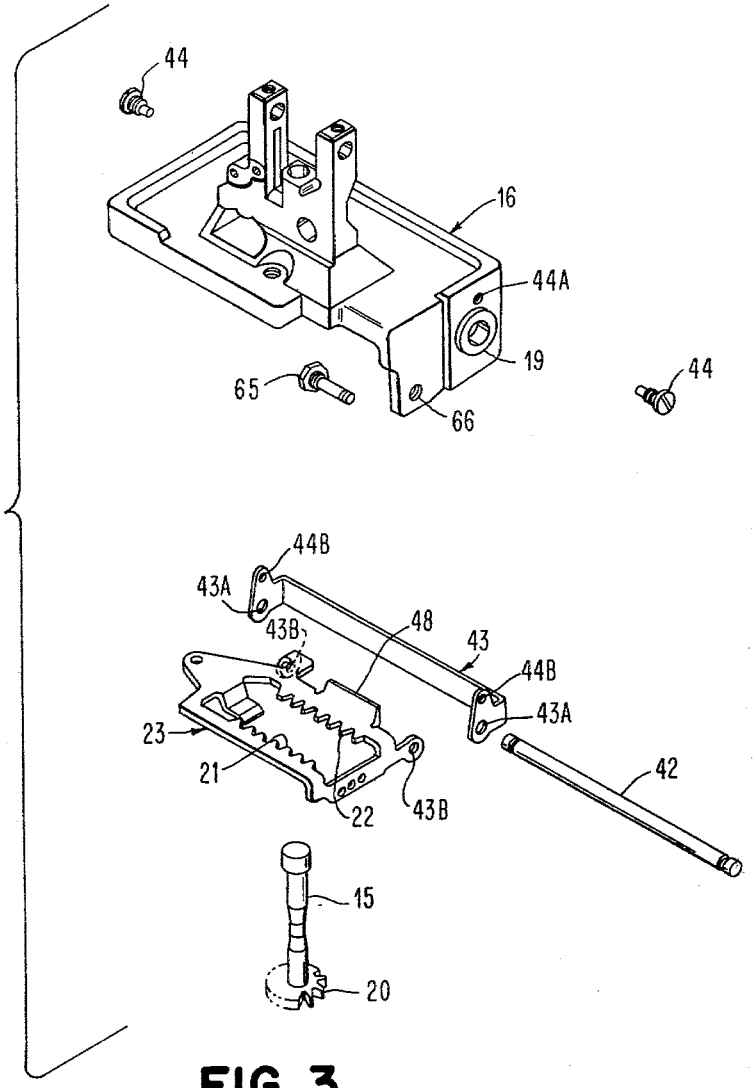
FIG. 3 is an exploded perspective view of a portion of the mechanism of the typewriter of FIG. 1 for causing rotation of the print element in two different directions depending upon whether its shift mechanism is effective.

It also should be understood that the rack member 23 (see FIGS. 2 and 3) has a tooth 48 to guide the rack member 23 during its movement to cause rotation of the pinion 20 (see FIG. 3). The tooth 48 fits within a groove 48' (see FIG. 2) in a rack guide 49, which is mounted on the rocker 16, when the rack 22 (see FIG. 3) engages the pinion 20. When the rack 21 engages the pinion 20, the tooth 48 rides along an end surface 49' (see FIG. 2) of the rack guide 49. When the rack member 23 is moved by movement of the support 43 (see FIG. 3), the tooth 48 can move without engaging the groove 48' (see FIG. 2) in the rack guide 49 or the end surface 49' of the rack guide 49.

The filter shaft 29 (see FIG. 1) is rotated from an operational shaft 50 (see FIG. 2) through a timing belt connecting pulleys on the shafts 29 (see FIG. 1) and 50 (see FIG. 2). The operational shaft 50 is driven from a motor (not shown) through 360° each time that one of the characters on the single print element 11 is to be printed through a cycle clutch (not shown) being activated.

The operational shaft 50 has a velocity cam 51 mounted thereon to control the velocity at which the single print element 11 impacts the record sheet 12. The velocity cam 51 has a low velocity profile 52 (see FIG. 5) and a high velocity profile 53 adjacent each other.

A cam follower 54 (see FIGS. 4 and 5), which is a roller, is mounted on an arm 55 and is normally in engagement with the high velocity profile 53 of the velocity cam 51. The cam follower 54 is mounted on the arm 55 through being rotatably mounted on a stud 56 (see FIG. 4), which is fixed to the arm 55. The cam follower 54 is disposed between two ears of a yoke 57, which also is rotatably mounted on the stud 56. A spring 58 acts between a surface of the arm 55 and one of the ears of the yoke 57 to urge the cam follower 54 into engagement with the low velocity profile 52 (see FIG. 5) of the velocity cam 51.

The yoke 57 (see FIG. 4) includes a guide finger 59 having a bifurcated open end 60 sliding along a stud 61, which also is fixed to the arm 55. A retainer 62 holds the yoke 57 on the stud 56 through being disposed in a slot 63 in the outboard end of the stud 56.

The end of the arm 55 remote from the end having the stud 61 has a pair of aligned apertures 64 to receive a pivot pin 65 (see FIG. 3). The pivot pin 65, which extends through a threaded hole 66 in the rocker 16 in which it is threaded, pivotally mounts the arm 55 (see FIG. 2) on the rocker 16. A retaining ring 66' (see FIG. 4) cooperates with a groove in the end of the pivot pin 65 (see FIG. 3) to hold the arm 55 (see FIG. 4) thereon.

The arm 55 has a lower curved surface 67 intermediate its ends resting on the top of a curved surface 68 of a fulcrum 69. The fulcrum 69 is mounted on the rocker bracket 17 by an eccentric 70, which has a flat surface 71 (see FIG. 4) for cooperation with a pair of set screws 72 in the rocker bracket 17 to enable positioning of the curved surface 68 of the fulcrum 69 at the desired angular relation to the lower curved surface 67 of the arm 55, being disposed within an opening 72' in one of the side walls 40B of the rocker bracket 17.

After the fulcrum 69 has been disposed at the desired angular position through utilization of the set screws 72, the fulcrum 69 can be pivoted about a cylindrical portion 73 of the eccentric 70 on which it is supported by movement of an impact control lever 74. The lever 74 is pivotally mounted on a stud 75, which is fixed to an ear 76 of a detent 77. The detent 77 is attached by a pair of screws 78 to the rocker bracket 17 through the screws 78 extending into threaded holes 78' in the rocker bracket 17.

An arm 79, which also is pivotally mounted on the stud 75, is responsive to the pivoting of the lever 74 about the stud 75 through having a pin 80, which is carried by the lever 74 through being held thereon by a nut 80', disposed in a bifurcated open end 81 of a first finger 82 of the arm 79. The arm 79 has a second finger 83 with a bifurcated open end 84 cooperating with a pin 85, which is attached to the upper end of the fulcrum 69. Therefore, pivoting of the lever 74 causes pivoting of the fulcrum 69 about the cylindrical portion 73 of the eccentric 70 to slightly change the position of the curved surface 68 of the fulcrum 69 relative to the lower curved surface 67 of the arm 55.

The lever 74 has a tab 86 on its upper end for cooperating with the detent 77 to hold the lever 74 in the position to which it is moved. Thus, the lever 74 is prevented from moving unless the tab 86 is withdrawn from engagement with the detent 77.

As the operational shaft 50 (see FIG. 2) rotates during each cycle, the cam 51 acts on the cam follower 54 to cause the arm 55 to pivot about the fulcrum 69. As a result of the arm 55 pivoting about the fulcrum 69, the rocker 16 is pivoted to cause the single print element 11 to impact the record sheet 12. If the cam follower 54 is engaging the high velocity profile 53 (see FIG. 5) on the cam 51, then the impact of the character on the single print element 11 (see FIG. 2) is at a higher velocity than if the cam follower 54 is riding on the low velocity profile 52 (see FIG. 5) of the cam 51.

The cam follower 54 rides on the high velocity profile 53 of the velocity cam 51 when the area of coverage of the character is relatively large. The cam follower 54 rides on the low velocity profile 52 of the velocity cam 51 when the area of coverage of the character is relatively small.

The cam follower 54 is shifted from riding on the high velocity profile 53 on the cam 51 to riding on the low velocity profile 52 when a vane 90 (see FIG. 1), which is an L-shaped member, is pivotally moved about its pivotal connections to the shift levers 32. The vane 90 has a pair of ears 91 with each of the ears 91 having a trunnion 92 disposed in an opening 93 in one of the shift levers 32 to enable pivotal mounting of the vane 90 between the shift levers 32.

The vane 90, which is in a substantially vertical plane, is disposed in the path of movement of each of the interposers 28 in the first direction, which is in a substantially horizontal direction. When the shift levers 32 are not effective, the lower portion of the vane 90 is disposed in the path of movement of each of the interposers 28 in the first direction, which is towards the vane 90. When the shift levers 32 are depressed, the vane 90 is moved downwardly in a substantially vertical direction transverse to the first direction to dispose the upper portion of the vane 90 in the path of each of the interposers 28 when each of the interposers 28 moves in the first direction.

If the vane 90 is not to be moved about its pivotal connections to the shift levers 32 by one of the interposers 28 when the interposer 28 is moved in the first direction and the shift levers 32 have not been depressed, then an opening 94 is formed in the lower portion of the vane 90 in the path of the activated interposer 28. If the vane 90 is to be pivoted by movement of the activated interposer 28 in the first direction, then the lower portion of the vane 90 opposite the activated interposer 28, which is to move the vane 90, is a portion 95 of the vane 90 in the path of the activated interposer 28.

When the shift levers 32 have been depressed so that an upper case character is to be selected for printing, then the upper portion of the vane 90 is disposed in the path of each of the interposers 28 when it moves in the first direction. If the vane 90 is to be moved when one of the interposers 28 is moved in the first direction, then the vane 90 has its portion 96, which is in the path of the activated interposer 28 when it moves in the first direction, disposed opposite the interposer 28. If the vane 90 is not to be moved when one of the interposers 28 is moved in the first direction, then the portion of the vane 90 opposite the activated interposer 28 has an opening 97 therein.

The vane 90 can have the openings 94 and 97 therein to form a continous opening in both the upper and lower portions of the vane 90. Thus, for the interposer 28 having the openings 94 and 97 positioned in its path of movement when the interposer 28 moves in the first direction, there is no movement of the vane 90 irrespective of whether the selected character is the upper case character or the lower case character for the activated interposer 28. Similarly, the vane 90 can have the portions 95 and 96 disposed in the path of one of the interposers 28 so that the interposer 28 causes pivoting of the vane 90 about its pivotal connections to the shift levers 32 irrespective of whether the shift levers 32 are in the depressed condition or not.

Therefore, when the shift levers 32 are not depressed, the vane 90 has its lower portion with either the opening 94 or the portion 95 in the path of each of the interposers 28 so that each of the interposers 28 either passes through one of the openings 94 or engages one of the portions 95 of the vane 90. Thus, the openings 94 and the portions 95 comprise first cooperating means cooperating with the interposers 28.

When the shift levers 32 are depressed, the vane 90 has the portions 96 of the vane 90 and the openings 97 in the upper portion formed for cooperation with the interposers 28. Therefore, the portions 96 of the vane 90 and the openings 97 in the vane 90 constitute second cooperating means of the vane 90 cooperating with the interposers 28.

The vane 90 has a tab 100 projecting downwardly from its bottom 101. The tab 100 has one end of a link 102 pivotally connected thereto while the other end of the link 102 is pivotally connected to a bellcrank 103 (see FIG. 5), which is pivotally mounted on a stud 104 fixed to the bottom casting 19' of the frame of the typewriter 10. A spring 105, which is preferably a Flex'ator spring sold by Hunter Spring Company, Lansdale, Pennsylvania, has one end secured to the bellcrank 103 and its other end fixed to a stud 106, which also is fixed to the bottom casting 19' of the frame of the typewriter 10. Accordingly, the spring 105 continuously urges the bellcrank 103 to a position in which an arm 107 of the bellcrank 103 engages the yoke 57, which rotatably supports the cam follower 54, to hold the cam follower 54 against the force of the spring 58 (see FIG. 4) so that the cam follower 54 (see FIG. 5) rides on the high velocity profile 53 of the cam 51.

Thus, when the vane 90 (see FIG. 1) is not pivoted by one of the interposers 28 engaging one of the portions 95 of the vane 90 or one of the portions 96 of the vane 90, dependent upon the position of the shift levers 32, the cam follower 54 (see FIG. 5) rides on the high velocity profile 53 of the cam 51 so that the single print element 11 (see FIG. 2) impacts the record sheet 12 at the high velocity. This is for a character having a relatively large area of coverage.

When the vane 90 (see FIG. 1) is pivoted by one of the interposers 28 engaging one of the portions 95 or 96, depending on the position of the shift levers 32, during movement of one of the interposers 28 in the first direction, the link 102 pivots the bellcrank 103 (see FIG. 5) about the stud 104 to withdraw the arm 107 from the position in which it holds the cam follower 54 on the high velocity profile 53 of the cam 51. As a result, the spring 58 (see FIG. 4) shifts the cam follower 54 (see FIG. 5) into engagement with the low velocity profile 52 of the cam 51. The movement of the cam follower 54 by the spring 58 (see FIG. 4) is limited by the yoke 57 (see FIG. 5) engaging the retainer 62 on the stud 56.

The cam 51 has a latching shoulder 108 on its end adjacent the low velocity profile 52. When the bellcrank 103 is pivoted by the link 102 being moved through pivoting of the vane 90 (see FIG. 1), the latching shoulder 108 (see FIG. 5), which is rotating with the cam 51 since it is integral therewith, moves between the arm 107 on the bellcrank 103 and the yoke 57.

Since the movement of the vane 90 (see FIG. 1) to pull the link 102 (see FIG. 5) is for a relatively short period of time during a cycle of operation of the operational shaft 50, the latching shoulder 108 has the arm 107 bearing thereagainst during a portion of the cycle of operation of the operational shaft 50 because the spring 105 continuously urges the arm 107 towards the yoke 57. After completion of pivotal movement of the arm 55 by the cam follower 54 being moved by the cam 51, the arm 107 against engages the yoke 57 to shift it against the force of the spring 58 to position the cam follower 54 on the high velocity profile 53 of the cam 51.

When the arm 107 of the bellcrank 103 is engaging the yoke 57 so that the cam follower 54 rides on the high velocity profile 53 of the cam 51, the latching shoulder 108 does not engage the arm 107 of the bellcrank 103. This is because the arm 107 is positioned out of the path of the latching shoulder 108 on the cam 51.

Accordingly, when the print element 11 (see FIG. 2) is to print a character having a relatively large area of coverage so that it is desired to have the print element 11 impact the record sheet 12 at the higher velocity, the vane 90 (see FIG. 1) has one of the openings 94 therein for cooperation with the activated interposer 28 if the selected character is a lower case character and one of the openings 97 therein for cooperation with the activated interposer 28 if the selected character is an upper case character. If the print element 11 (see FIG. 2) is to impact the record sheet 12 at the lower velocity because the area of coverage of the selected character is relatively small, then the vane 90 (see FIG. 1) has one of the portions 95 for engagement by the activated interposer 28 to pivot the vane 90 about its pivotal connections to the shift levers 32 when the interposer 28 moves in the first direction if the selected character is the lower case character. If the selected character is the upper case character, the vane 90 has one of the portions 96 disposed in the path of the activated interposer 28 to pivot the vane 90 about its pivotal connections to the shift levers 32 when the interposer 28 moves in the first direction.

As a result of pivoting of the vane 90 by the activated interposer 28, the link 102 moves the bellcrank 103 (see FIG. 5) against the force of the spring 105. This allows the cam follower 54 to be shifted by the spring 58 (see FIG. 4) for cooperation with the low velocity profile 52 (see FIG. 5) of the cam 51 so that the print element 11 (see FIG. 2) impacts the record sheet 12 at the lower velocity.

Considering the operation of the present invention, one of the keybuttons 25 (see FIG. 1) of the keyboard 26 is depressed to select a character. This causes the filter shaft 29 to rotate to move the interposer 28, which cooperates with the keylever 27 of the depressed keybutton 25, in the first direction.

If the lower case character for the selected keybutton 25 is to be printed on the record sheet 12 (see FIG. 2), then the shift levers 32 (see FIG. 1) are not depressed. If the upper case character for the selected keybutton 25 is to be printed on the record sheet 12 (see FIG. 2), then the shift levers 32 (see FIG. 1) are depressed.

The motion of the activated interposer 28 causes each of the code lugs 30 on the activated interposer 28 to engage the cooperating bail 31. This produces rotation and/or tilting of the print element 11 (see FIG. 2) in the manner shown and described in the aforesaid de Kler and Hughes patents.

The movement of the activated interposer 28 (see FIG. 1) in the first direction causes the interposer 28 to move into the plane of the lower portion of the vane 90. If the selected character requires the print element 11 (see FIG. 2) to impact the record sheet 12 at the lower velocity, the interposer 28 (see FIG. 1) engages one of the portions 95 of the vane 90. This causes the link 102 (see FIG. 5) to pivot the bellcrank 103 against the force of the spring 105 and withdraw the arm 107 from engagement with the yoke 57. This results in the spring 58 (see FIG. 4) moving the cam follower 54 (see FIG. 5) to cooperate with the low velocity profile 52 of the cam 51 so that pivoting of the arm 55 about the curved surface 68 (see FIG. 4) of the fulcrum 69 is at a lower velocity. This pivoting of the arm 55 at the lower velocity causes pivoting of the rocker 16 (see FIG. 2) to be at a lower velocity so that the print element 11 impacts the record sheet 12 at the lower velocity.

If the shift levers 32 (see FIG. 1) have been depressed because the selected character is the upper case character of the two characters on the depressed keybutton 25, the vane 90 would have been moved downwardly substantially transverse to the first direction by the depression of the shift levers 32 (Although the shift levers 32 are pivotally mounted, the relatively long distance from the fulcrum rod 35 produces a substantially vertical movement of the vane 90.). As a result of movement of the vane 90 from its first position (lower case) to its second position (upper case), the activated interposer 28 would either engage one of the portions 96 of the vane 90 or pass through one of the openings 97 in the vane 90 when the activated interposer 28 moves in the first direction. If the interposer 28 passes through one of the openings 97, the vane 90 does not move. However, if the interposer 28 engages the portion 96 of the vane 90, then the vane 90 pivots about its pivotal connections to the shift levers 32 to cause movement of the link 102 whereby the cam roller 54 (see FIG. 5) again cooperates with the low velocity profile 52 of the cam 51.

When the link 102 pivots the bellcrank 103 against the force of the spring 105, the arm 107 of the bellcrank 103 is disposed so that the latch shoulder 108 on the cam 51 passes between the arm 107 and the yoke 57 prior to the link 102 ceasing to be effective to hold the bellcrank 103 against the force of the spring 105. Thus, the cam follower 54 remains on the low velocity profile 52 of the cam 51 until after pivoting of the rocker 16 (see FIG. 2) by pivotal movement of the arm 55 about the curved surface 68 of the fulcrum 69 has been completed.

While the mechanism of the present invention has been shown and described as being utilized with a typewriter, it should be understood that the mechanism of the present invention could be used with any printing device having a single print element. While the present invention has shown and described the selection of each of the characters being by depression of one of the keybuttons 25 (see FIG. 1), it should be understood that any other suitable means could be employed for causing activation of each of the interposers 28 to select each character. While the present invention has shown and described the shift levers 32 as being activated by depression of one of the keybuttons 34, it should be understood that any other suitable means for causing movement of the operatively connected shift levers 32 could be employed.

While the vane 90 has been shown and described as being pivoted when the print element 11 (see FIG. 2) is to impact the record sheet 12 at the lower velocity, it should be understood that such is not a requisite for satisfactory operation of the present invention. Thus, through utilizing a different velocity cam arrangement, for example, the pivoting of the vane 90 could cause the print element 11 to impact the record sheet 12 with the higher velocity.

An advantage of this invention is that its cost is relatively low in comparison with the previous mechanism. Another advantage of this invention is that it reduces the number of parts required for controlling the velocity in comparison with the prior mechanism. A further advantage of this invention is that it reduces the assembly time in comparison with the previous mechanism.

While the invention has been particularly shown and described with reference to a preferred embodiment thereof, it will be understood by those skilled in the art that various changes in form and detail may be made therein without departing from the spirit and scope of the invention.

What is claimed is:

1. A single print element printer including:

a single print element having a plurality of characters thereon, said print element impacting a record sheet to print a selected character thereon;

velocity control means to control the velocity at which said print element impacts the record sheet to print the selected character;

selection means to select one of the characters on said print element for printing on the record sheet when said print element impacts the record sheet;

said selection means including a plurality of movable means movable in a first direction, each of said movable means being movable in response to selection of one of two characters on said print element with one of the two characters being in one of two cases and the other of the two characters being in the other of the two cases;

shift means to cause said print element to have the selected character in one of the two cases impact the record sheet when one of said movable means is moved in the first direction and said shift means is effective, the selected character in the other of the two cases impacting the record sheet when said one movable means is moved in the first direction and said shift means is not effective;

a member movable from a first position to a second position in a substantially vertical direction and substantially transverse to the first direction when said shift means is effective;

said member including first cooperating means for cooperating with each of said movable means when said member is in its first position and second cooperating means for cooperating with each of said movable means when said member is in its second position, said second cooperating means being disposed above said first cooperating means;

said first cooperating means including causing means engageable by one of said movable means when said one movable means moves in the first direction to cause movement of said member when said print element is to impact the record sheet at a first velocity and enabling means to enable movement of one of said movable means in the first direction without causing movement of said member by said one movable means when said print element is to impact the record sheet at a second velocity;

said second cooperating means including causing means engageable by one of said movable means when said one movable means moves in the first direction to cause movement of said member when said print element is to impact the record sheet at a first velocity and enabling means to enable movement of one of said movable means in the first direction without causing movement of said member by said one movable means when said print element is to impact the record sheet at a second velocity;

and responsive means responsive to movement of said member by one of said movable means moving in the first direction to engage said causing means of one of said first cooperating means and said second cooperating means to cause said velocity control means to change the velocity at which said print element impacts the record sheet.

2. The printer according to claim 1 in which:

each of said enabling means of said first cooperating means and each of said enabling means of said second cooperating means is an opening in said member to enable movement of said movable means in the first direction without engaging said member;

and each of said causing means of said first cooperating means and each of said causing means of said second cooperating means includes a portion of said member engageable by said movable means when said movable means moves in the first direction.

3. The printer according to claim 2 in which:

said shift means includes a pair of pivotally mounted levers operatively connected together and movable between a first position in which said shift means is not effective and a second position in which said shift means is effective;

said member extends between said pivotally mounted levers;

and means connects said member to each of said pivotally mounted levers for movement with said levers between its first position and its second position while enabling movement of said member by one of said movable means when a portion of said member is engaged by said one movable means.

4. The printer according to claim 3 in which:

said selection means includes character selection means;

and each of said movable means includes an interposer movable in the first direction in response to activation of one of said character selection means.

5. The printer according to claim 4 in which said responsive means includes means connecting said member to said velocity control means to cause said velocity control means to control the velocity in accordance with whether said member is moved by one of said interposers.

6. The printer according to claim 3 in which said responsive means includes means connecting said member to said velocity control means to cause said velocity control means to control the velocity in accordance with whether said member is moved by one of said movable means.

7. The printer according to claim 2 in which:

said shift means includes at least one pivotally mounted lever movable between a first position in which said shift means is not effective and a second position in which said shift means is effective;

and mounting means to mount said member for movement with said pivotally mounted lever between its first position and its second position.

8. The printer according to claim 7 in which said mounting means includes means to connect said member to said pivotally mounted lever for movement relative thereto by one of said movable means engaging one of said portions of said member.

9. The printer according to claim 8 in which said responsive means includes means connecting said member to said velocity control means to cause said velocity control means to control the velocity in accordance with whether said member is moved by one of said movable means.

10. The printer according to claim 2 in which:

said selection means includes character selection means;

and each of said movable means includes an interposer movable in the first direction in response to activation of one of said character selection means.

11. The printer according to claim 10 in which said responsive means includes means connecting said member to said velocity control means to cause said velocity control means to control the velocity in accordance with whether said member is moved by one of said interposers.

12. The printer according to claim 2 in which said responsive means includes means connecting said member to said velocity control means to cause said velocity control means to control the velocity in accordance with whether said member is moved by one of said movable means.

13. The printer according to claim 1 in which said responsive means includes means connecting said member to said velocity control means to cause said velocity control means to control the velocity in accordance with whether said member is moved by one of said movable means.

* * * * *